US006227932B1

(12) United States Patent
Ngai

(10) Patent No.: US 6,227,932 B1
(45) Date of Patent: May 8, 2001

(54) TOY RACING CAR TRACK SYSTEM

(75) Inventor: Kam Fai Ngai, Shatin (HK)

(73) Assignee: Artin Industrial Co., Ltd., Kowloon (HK)

( * ) Notice: Subject to any disclaimer, the term of this patent is extended or adjusted under 35 U.S.C. 154(b) by 0 days.

(21) Appl. No.: 09/360,165

(22) Filed: Jul. 26, 1999

(51) Int. Cl.[7] ..... A63H 18/00
(52) U.S. Cl. ..... 446/444; 446/445; 446/446
(58) Field of Search ..... 446/444, 445, 446/446, 429; 463/62, 63

(56) References Cited

U.S. PATENT DOCUMENTS 3,337,985 * 8/1967 Ryan et al. .
3,367,284 * 2/1968 Lunzer .
3,402,503 * 9/1968 Glass et al. ..... 463/62
3,545,757 * 12/1970 Tepper .
3,986,717 * 10/1976 Kirby et al. .
4,221,076 * 9/1980 Ozawa .
4,550,910 * 11/1985 Goldfarb et al. ..... 463/62
4,697,812 * 10/1987 Rudell et al. .
4,838,828 * 6/1989 Ohnuma et al. ..... 446/446

* cited by examiner

*Primary Examiner*—Jacob K. Ackun
*Assistant Examiner*—Kurt Fernstrom
(74) *Attorney, Agent, or Firm*—Leydig, Voit & Mayer, Ltd.

(57) ABSTRACT

A track system for a toy racing car, including a loop of track sections connected end-to-end together to form a lane for an electric toy car to run along, includes a track section having a body with a groove for guiding the movement of the toy car, a pair of conductive rails on opposite sides of the groove for supplying electrical power to the toy car, and a substantially flat upper surface with recesses on opposite sides of the rails for positioning respective obstacles for riding over by the wheels of the toy car. Some of the obstacles are rotatable and some of the obstacles are fixed.

7 Claims, 2 Drawing Sheets

TOY RACING CAR TRACK SYSTEM

The present invention relates to a track section for use in an electric toy racing car track system.

BACKGROUND OF THE INVENTION

In a conventional construction, an electric toy racing car track system is formed by a loop of track sections which are connected end-to-end together to form a pair of coextending lanes for respective toy cars to race with each other. Each lane is provided with a central groove for guiding a respective toy car by its bottom guide pin and a pair of conductive rails on opposite sides of the guiding groove for supplying electrical power to the toy car via respective brush contacts on the bottom of the car. The track sections have, invariably, a flat upper surface for the toy cars to run along in a manner which is smooth but monotonous.

The subject invention seeks to provide a track section for a toy racing car track system, which adds variation and fun to the game.

SUMMARY OF THE INVENTION

According to the invention, there is provided a track section for use in a toy racing car track system formed by a loop of track sections connected end-to-end together to form at least one lane for an electric toy car to run along and including a groove for guiding the movement of and a pair of conductive rails on opposite sides of the groove for supplying electrical power to the toy car, which track section comprises a body having a substantially flat upper surface formed with formations on at least one outer side of the rails for removably positioning respective obstacles for riding over by the wheels of the toy car.

Preferably, the formations are formed on opposite outer sides of the rails.

More preferably, the formations on each side of the rails are out of lateral alignment with the formations on the opposite side of the rails.

Further more preferably, the formations on each side of the rails are regularly spaced to form a row and are staggered with the formations of the row on the opposite side of the rails.

It is preferred that the formations are in the form of recesses for receiving bottom parts of the respective obstacles.

More preferably, the stone pieces are capable of providing a smooth transit for the wheels of the toy car to ride over them from the track section surface.

Further more preferably, the obstacles have a leading surface which is positioned or self-positioning to take the wheels of the toy car, thereby providing the smooth transit.

In a first preferred embodiment, the leading surface of at least one of the obstacles is pivotable to provide the smooth transit.

More preferably, the at least one obstacle has a body presenting the leading surface and including a pair of hinge pins on opposite sides for engaging with opposite sides of the respective recess.

In a second preferred embodiment, the leading surface of at least one of the obstacles is inclined or curved from the track section surface to provide the smooth transit.

More preferably, the at least one obstacle is fixed and has a body presenting the leading surface and including a bottom protrusion for press fitting into the respective recess.

The invention also provides a toy car racing track system including the aforesaid track section.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
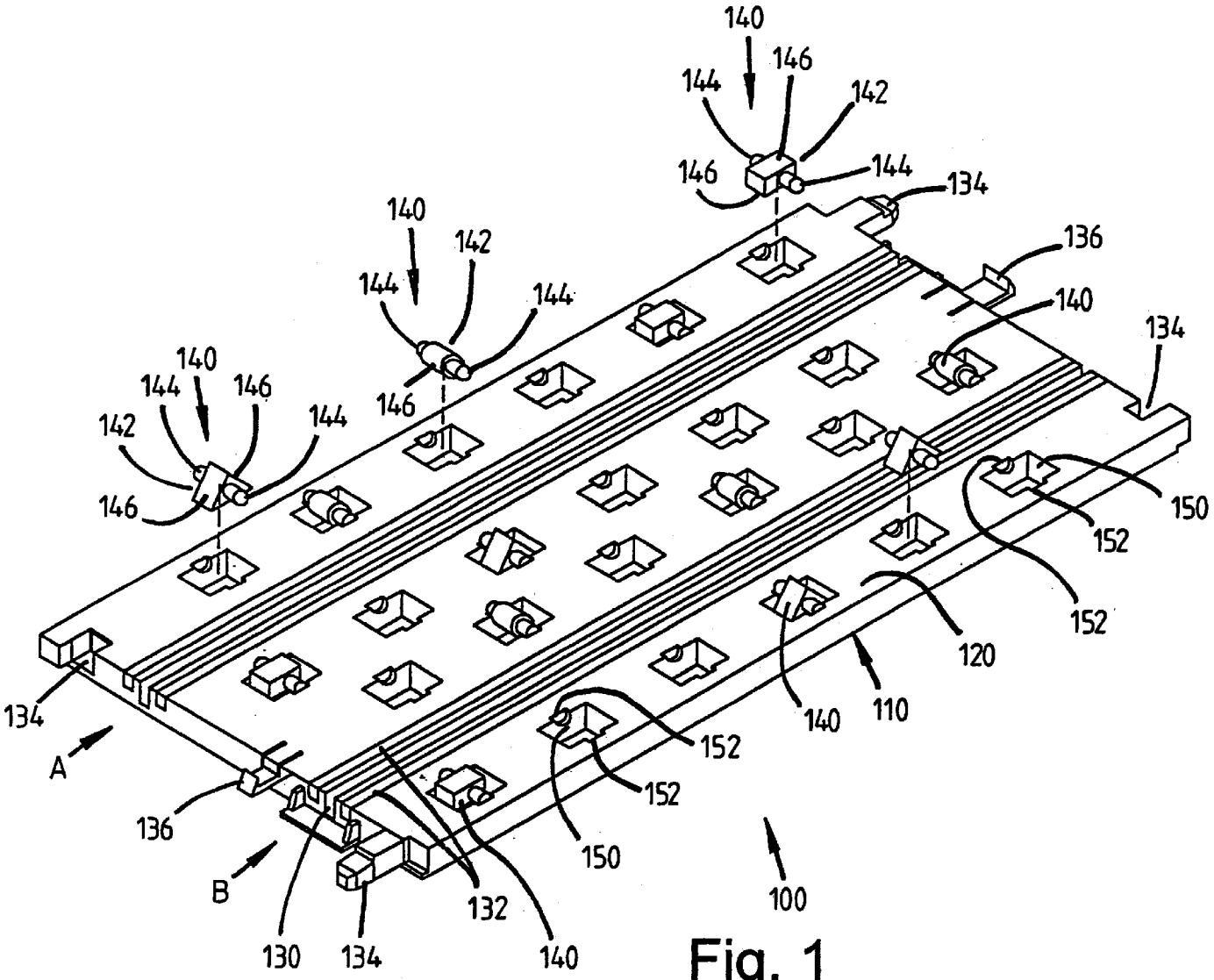
FIG. 1 is a perspective view of a first embodiment of a toy racing car track section in accordance with the invention, said track section incorporating a first type of obstacles.
Figure 3:
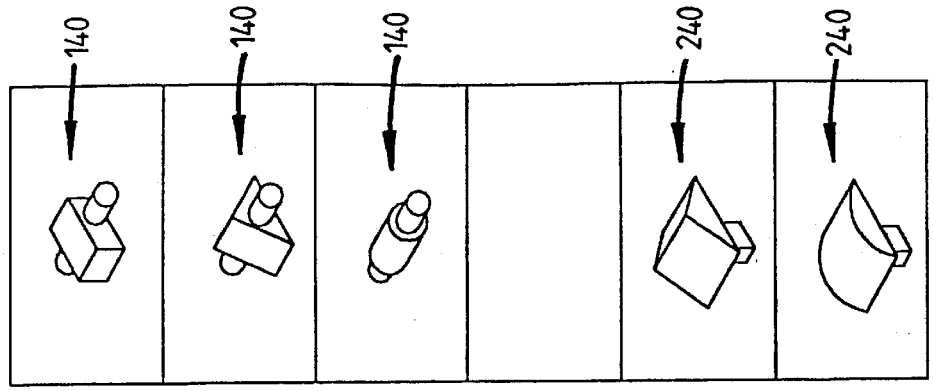
FIG. 3 is a perspective view showing both types of the removably positionable obstacles of FIGS. 1 and 2.

Referring initially to FIGS. 1 and 3 of the drawings, there is shown a first track section 100 embodying the invention for use in a conventional electric toy car racing track system. The track system is typically constructed by a loop of track sections connected end-to-end together to form a pair of co-extending lanes for respective toy cars to race with each other. Extending along each lane, the track sections are formed with a central groove for guiding a respective toy car by its bottom guide pin and a pair of conductive rails on opposite sides of the guiding groove for supplying electrical power to the toy car via respective contact brushes on the bottom of the car. Most of the track sections are constructed and interconnected in a conventional manner that is generally known in the art, except the subject track section 100 which is provided with a plurality of removably positionable obstacles 140 of different shapes.

The track section 100 has a rectangular planar body 110 having a generally flat upper surface 120 to provide a pair of straight lane sections A and B on opposite sides. Each lane section A/B is formed with a central guiding groove 130 and a pair of power supply rails 132 on opposite sides of the groove 130. The body 110 includes plug-and-socket connectors 134 and hooks 136 at opposite ends for interconnection with adjacent track sections of the conventional type.

Two rows of the obstacles 140 are provided on opposite (at least one) outer sides of the rails 132 of each lane A/B, at positions where the wheels of a respective toy car will be rolling. More specifically, the obstacles 140 of each row are regularly spaced and are staggered with each other between the two rows, out of lateral alignment, so that when the toy car rides over them, both of its front or rear wheels will not be subject to bumping at the same time.

For removably positioning the obstacles 140, the track section body 110 includes with respective rectangular recesses 150. Each recess 150 has opposite sides with a pair of aligned semi-circular indentations 152. Each obstacle 140 has a body 142 including a pair of integral hinge pins 144 on opposite sides. With respect to the central axis defined by the hinge pins 144, the body 142 has a lateral cross-section in a shape which is rectangular, triangular, or circular (FIG. 3).

Each obstacle 140 is removably placed partially (about half) within the respective recess 150, with the hinge pins 144 engaging the corresponding indentations 152 such that the body 142 is supported for free rotational or pivotal movement.

The body 142 of the rectangular obstacle 140 has upper and lower principal surfaces 146. When the wheel of the toy car rides initially onto this obstacle 140, the obstacle 140 will be pivoted towards the wheel to present its upper surface 146 as a leading surface inclined to take the wheel, thereby providing a smooth transit for the wheel from the track body surface 120. The transit is smooth in the sense that the wheel will not hit a rigid step. Subsequent movement of the wheel will cause the obstacle 140 to pivot and then align in the opposite direction until the wheel leaves. In the situation where the obstacle 140 is not generally flat, such as in an upright position, it may be pivoted by the wheel in the opposite direction alone for both engaging the wheel and letting it ride past.

The body 142 of the triangular obstacle 140 has three adjoining surfaces 146. When the wheel of the toy car rides initially onto this obstacle 140, the obstacle 140 will present its leading upper surface 146 readily inclined to take the wheel, thereby providing a similar smooth transit for the wheel. Subsequent movement of the wheel will cause the obstacle 140 to pivot onwards until the wheel leaves. Afterwards, the obstacle 140 will return to its upright position under the action of gravity.

The body 142 of the circular obstacle 140 has a cylindrical surface 146. When the wheel of the toy car rides initially onto this obstacle 140, the obstacle 140 will present the leading side of its surface 146 rotatably to take the wheel, thereby providing a similar smooth transit for the wheel. Subsequent movement of the wheel will cause the obstacle 140 to rotate onwards until the wheel leaves.

Figure 2:
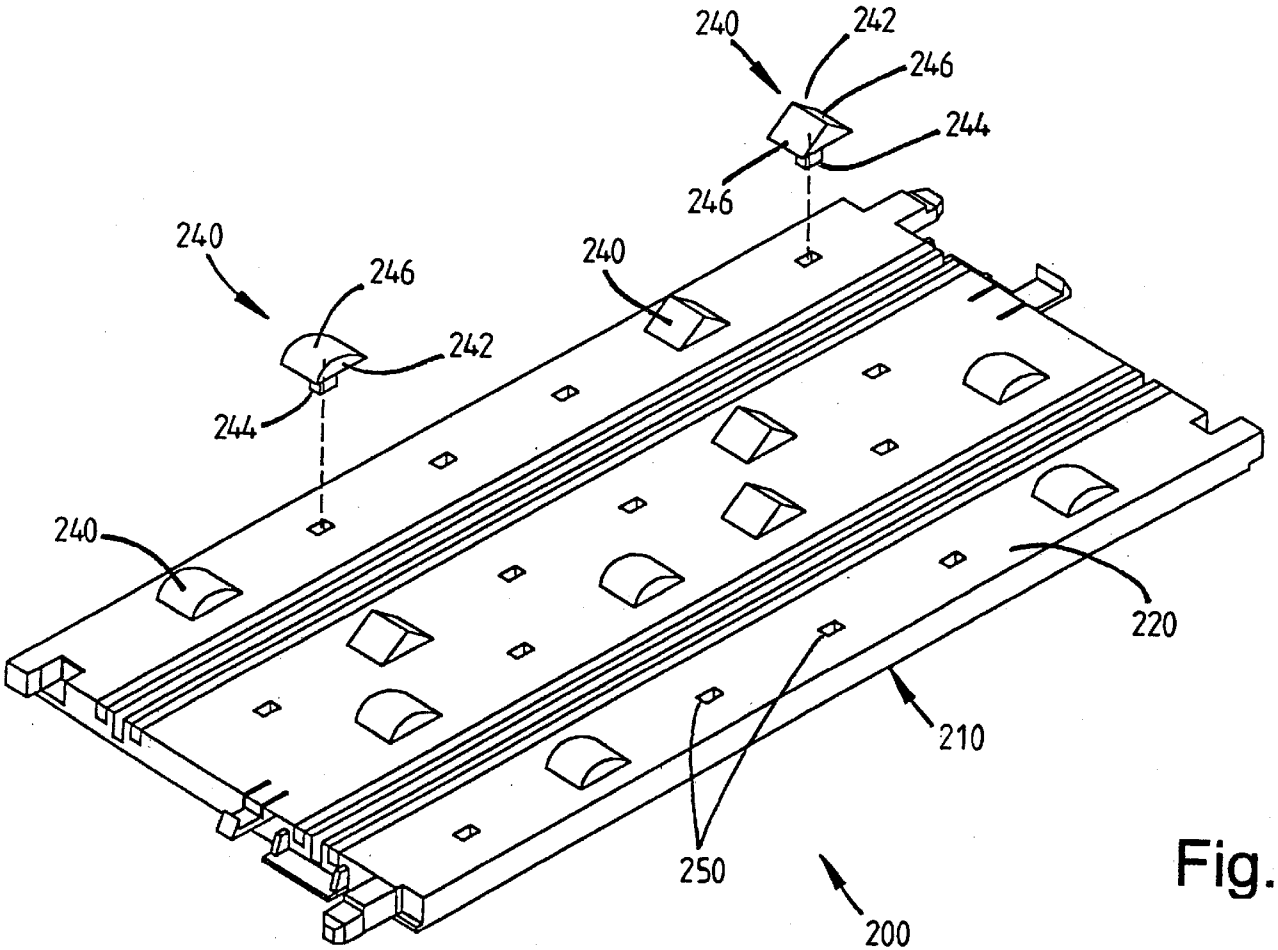
FIG. 2 is a perspective view of a second embodiment of a toy racing car track section in accordance with the invention, said track section incorporating a second type of obstacles.

Reference is now made to FIGS. 2 and 3 of the drawings showing an alternative second track section 200 embodying the invention, which track section 200 has a body 210 having an upper surface 220 similar to the first track section body 110, except having relatively smaller recesses or holes 250 equivalent to the recesses 150. The second track section 200 makes use of obstacles 240 which are fixed and of a different construction.

Each obstacle 240 has a body 242 including a bottom peg 244 for press fitting into the respective hole 250. The body 242 has a lateral cross-section of a shape which is either triangular or partially-circular (FIG. 3).

The body 242 of the triangular obstacle 240 has two mutually inclined adjoining upper surfaces 246. When the wheel of the toy car initially rides onto this stone piece 240, the obstacle 240 will present its leading upper surface 246 readily inclined to take the wheel, thereby providing a smooth transit for the wheel from the track body surface 220. The transit is smooth in the sense that the wheel will not hit a rigid step.

The body 242 of the part-circular obstacle 240 has a curved upper surface 246. When the wheel of the toy car initially rides onto this obstacle 240, the obstacle 240 will present the leading side of its upper surface 246 curved and inclined to engage the wheel, thereby providing a similar smooth transit for the wheel.

The various obstacles 140/240 provide different bumping characteristics to the toy cars, as desired by the players when setting up the track section 100/200. Also, some of the recesses/holes 150/250 may be left empty to form holes in the road for the toy cars to cross. All such features add variation and fun to the game.

The invention has been given by way of example only, and various modifications of and/or alterations to the described embodiments may be made by persons skilled in the art without departing from the scope of the invention as specified in the appended claims.

What is claimed is:

1. A track system for a toy racing car including a loop of track sections connected end-to-end together to form at least one lane for an electric toy car to run along, the track system including:

a track section having a body including a groove for guiding movement of the toy car, a pair of conductive rails on opposite sides of the groove for supplying electrical power to the toy car, and a substantially flat surface including recesses located on opposite outer sides of the rails; and a plurality of obstacles removably positionable in respective recesses for riding over by wheels of the toy car wherein the recesses are staggered along the rails so that no recesses are directly opposite each other on opposite sides of the rails along a line perpendicular to the rails and at least one of the obstacles has a triangular cross section parallel to the rails.

2. A track system for a toy racing car including a loop of track sections connected end-to-end together to form at least one lane for an electric toy car to run along the track system including:

a track section having a body including a groove for guiding movement of the toy car, a pair of conductive rails on opposite sides of the groove for supplying electrical power to the toy car, and a substantially flat surface including recesses located on opposite outer sides of the rails; and a plurality of obstacles removably positionable in respective recesses for riding over by wheels of the toy car wherein the recesses are staggered along the rails so that no recesses are directly opposite each other on opposite sides of the rails along a line perpendicular to the rails and at least one of the obstacles has a rectangular cross section parallel to the rails.

3. A track system for a toy racing car including a loop of track sections connected end-to-end together to form at least one lane for an electric toy car to run along, the track system including:

a track section having a body including a groove for guiding movement of the toy car, a pair of conductive rails on opposite sides of the groove for supplying electrical power to the toy car, and a substantially flat surface including recesses located on opposite outer sides of the rails; and a plurality of obstacles removably positionable in respective recesses for riding over by wheels of the toy car wherein the recesses are staggered along the rails so that no recesses are directly opposite each other on opposite sides of the rails along a line perpendicular to the rails and at least one of the obstacles has a circular cross section parallel to the rails.

4. A track system for a toy racing car including a loop of track sections connected end-to-end together to form at least one lane for an electric toy car to run along, the track system including:

a track section having a body including a groove for guiding movement of the toy car, a pair of conductive rails on opposite sides of the groove for supplying electrical power to the toy car, and a substantially flat surface including recesses located on opposite outer sides of the rails, the recesses including pivot supports at opposite sides of the recesses; and a plurality of obstacles removably positionable in respective recesses for riding over by wheels of the toy car wherein the obstacles include, at opposite sides, protruding pivot structures, receiveable in the pivot supports and at least one of the obstacles has a triangular cross section parallel to the rails, whereby the obstacles rotate within the recesses about the pivot supports when ridden over by the wheels of the toy car original.

5. A track system for a toy racing car including a loop of track sections connected end-to-end together to form at least one lane for an electric toy car to run along, the track system including:

a track section having a body including a groove for guiding movement of the toy car. a pair of conductive rails on opposite sides of the groove for supplying electrical power to the toy car, and a substantially flat surface including recesses located on opposite outer sides of the rails, the recesses including pivot supports at opposite sides of the recesses; and a plurality of obstacles removably positionable in respective recesses for riding over by wheels of the toy car wherein the obstacles include, at opposite sides, protruding pivot structures, receiveable in the pivot supports and at least one of the obstacles has a rectangular cross section parallel to the rails, whereby the obstacles rotate within the recesses about the pivot supports when ridden over by the wheels of the toy car original.

6. A track system for a toy racing car including a loop of track sections connected end-to-end together to form at least one lane for an electric toy car to run along, the track system including:

a track section having a body including a groove for guiding movement of the toy car, a pair of conductive rails on opposite sides of the groove for supplying electrical power to the toy car, and a substantially flat surface including recesses located on opposite outer sides of the rails, the recesses including pivot supports at opposite sides of the recesses; and a plurality of obstacles removably positionable in respective recesses for riding over by wheels of the toy car wherein the obstacles include, at opposite sides, protruding pivot structures, receiveable in the pivot supports and at least one of the obstacles has a circular cross section parallel to the rails, whereby the obstacles rotate within the recesses about the pivot supports when ridden over by the wheels of the toy car original.

7. A track system for a toy racing car including a loop of track sections connected end-to-end together to form at least one lane for an electric toy car to run along, the track system including:

a track section having a body including a groove for guiding movement of the toy car, a pair of conductive rails on opposite sides of the groove for supplying electrical power to the toy car, and a substantially flat surface including recesses located on opposite outer sides of the rails, wherein the recesses are staggered along the rails so that no recesses are directly opposite each other on opposite sides of the rails along a line perpendicular to the rails and include pivot supports at opposite sides of the recesses; and a plurality of obstacles removably positionable in respective recesses for riding over by wheels of the toy car wherein the obstacles include, at opposite sides, protruding pivot structures, receiveable in the pivot supports and whereby the obstacles rotate within the recesses about the pivot supports when ridden over by the wheels of the toy car original.

* * * * *